US011547880B2

(12) United States Patent
Oliver, III

(10) Patent No.: US 11,547,880 B2
(45) Date of Patent: Jan. 10, 2023

(54) PARTICLE PROTECTION HEADWEAR APPARATUS

(71) Applicant: Lewis Maurice Oliver, III, Orlando, FL (US)

(72) Inventor: Lewis Maurice Oliver, III, Orlando, FL (US)

( * ) Notice: Subject to any disclaimer, the term of this patent is extended or adjusted under 35 U.S.C. 154(b) by 0 days.

(21) Appl. No.: 17/446,629

(22) Filed: Sep. 1, 2021

(65) Prior Publication Data

US 2022/0072347 A1 Mar. 10, 2022

Related U.S. Application Data

(60) Provisional application No. 62/706,713, filed on Sep. 4, 2020.

(51) Int. Cl.
*A62B 23/02* (2006.01)
*A42B 1/017* (2021.01)
(Continued)

(52) U.S. Cl.
CPC ..... *A62B 23/025* (2013.01); *A41D 13/1153* (2013.01); *A41D 13/1184* (2013.01);
(Continued)

(58) Field of Classification Search
CPC .. A42B 3/18; A42B 3/22; A42B 3/285; A42B 3/286; A42B 3/227; A42B 13/1153;
(Continued)

(56) References Cited

U.S. PATENT DOCUMENTS 1,131,350 A * 3/1915 Engelfried ..... A62B 17/04 128/201.23
1,359,393 A * 11/1920 Leak ..... A42B 1/0187 2/4

(Continued)

FOREIGN PATENT DOCUMENTS

CN 108244741 A * 7/2018
WO WO-2014189364 A1 * 11/2014 ..... A41D 13/11

OTHER PUBLICATIONS

PPE Advantage. "Bottlecap" Reusable Face Masks With Straw Hole For Drinking—Adjustable Elastic Ear Loops—Super Soft Organic Cotton—Comfortable Drinking Mask. Retrieved from internet. URL: https://www.amazon.com/Bottlecap-Reusable-Masks-Straw-Drinking/dp/B08DRL8P5L/?th=1. Jul. 28, 2020 (Year: 2020).*

*Primary Examiner* — Khoa D Huynh
*Assistant Examiner* — Aiying Zhao
(74) *Attorney, Agent, or Firm* — Dunlap Bennett & Ludwig, PLLC

(57) ABSTRACT

Embodiments of particle protection headwear apparatuses and use thereof are detailed herein. In general, embodiments of the present invention include a shield and a shroud which couple to, or are partially or wholly integral with, a hat. The shield extends downwardly from the hat and is typically embodied as part of the hat. Further, the shield is designed for a user to be able to look through it. The shroud is coupled to and extends downwardly from the shield and the hat. The shroud extends entirely around a perimeter of the hat to form a breathable barrier between particles and the user's head. The shroud may be removeable from the shield and washable.

17 Claims, 9 Drawing Sheets

(51) Int. Cl.

| | |
|---|---|
| ***A62B 17/04*** | (2006.01) |
| ***A42B 1/04*** | (2021.01) |
| ***A41D 13/11*** | (2006.01) |
| ***A42B 1/008*** | (2021.01) |

(52) U.S. Cl.
CPC ..... *A42B 1/008* (2013.01); *A42B 1/017* (2021.01); *A42B 1/04* (2013.01); *A62B 17/04* (2013.01)

(58) Field of Classification Search
CPC ..... A42B 13/1184; A42B 1/008; A42B 1/04; A62B 17/04; A61F 9/06; A61F 9/029
See application file for complete search history.

(56) References Cited

U.S. PATENT DOCUMENTS

| | | | | |
|---|---|---|---|---|
| 1,481,541 | A | 1/1924 | Douglas | |
| 1,791,609 | A * | 2/1931 | Woodman | A01K 55/00 2/4 |
| 2,472,033 | A * | 5/1949 | Wetzel | A42B 1/014 2/4 |
| 2,759,187 | A * | 8/1956 | Woodard | A62B 17/04 2/8.1 |
| 3,427,660 | A | 2/1969 | Raschke | |
| 3,577,563 | A * | 5/1971 | Raschke | A61F 9/025 2/8.1 |
| 3,702,607 | A | 11/1972 | Tucker et al. | |
| 5,054,480 | A | 10/1991 | Bare et al. | |
| 5,577,271 | A * | 11/1996 | Davis | A42B 1/0187 2/4 |
| 5,713,076 | A | 2/1998 | Davis | |
| 5,887,281 | A | 3/1999 | Green et al. | |
| 5,924,129 | A | 7/1999 | Gill | |
| 5,933,871 | A | 8/1999 | Kraft | |
| 5,950,241 | A * | 9/1999 | Gomez | A42B 1/201 2/172 |
| 6,298,498 | B1 | 10/2001 | Burns et al. | |
| 6,996,852 | B1 | 2/2006 | Cabrera | |
| 7,937,779 | B2 | 5/2011 | Klotz et al. | |
| 8,234,722 | B2 | 8/2012 | VanDerWoude et al. | |
| 8,302,599 | B2 | 11/2012 | Green | |
| 9,955,746 | B2 | 5/2018 | Dick | |
| 10,980,305 | B2 | 4/2021 | Bacinska et al. | |
| 2007/0113845 | A1 | 5/2007 | O'Brien et al. | |
| 2008/0066214 | A1 | 3/2008 | O'Hare | |
| 2009/0255025 | A1* | 10/2009 | Ochoa | A42B 3/286 2/7 |
| 2013/0305431 | A1 | 11/2013 | Mraz | |
| 2014/0189942 | A1* | 7/2014 | Coombs | A42B 1/247 2/424 |
| 2014/0298557 | A1 | 10/2014 | Townsend, Jr. et al. | |
| 2015/0057621 | A1* | 2/2015 | Coombs | A42B 1/0187 604/289 |
| 2015/0089709 | A1 | 4/2015 | DuCasse | |
| 2017/0079359 | A1 | 3/2017 | Chase | |
| 2020/0058264 | A1 | 2/2020 | Smith et al. | |
| 2021/0213154 | A1 | 7/2021 | Mintchev | |

* cited by examiner

PARTICLE PROTECTION HEADWEAR APPARATUS

CROSS-REFERENCE TO RELATED APPLICATION

This application claims the benefit of priority of U.S. provisional application No. 62/706,713, filed Sep. 4, 2020, the contents of which are herein incorporated by reference.

BACKGROUND OF THE INVENTION

The present invention relates to personal protective equipment (PPE), and more particularly to a virus protection headwear apparatus. Whenever used herein, virus may also be understood to apply to bacteria or any other potentially infectious or injurious particles that may be inhaled, or that may be introduced by a hand touching eyes, nose, or mouth.

Transmission of viral and bacterial infection in high exposure environments is a problem for which a solution is desperately needed. Current face masks and face shields leave gaps to allow virus-sized airborne particles in and out around the sides of the face mask. Face masks do not protect eyes from airborne particles. Face masks do not offer meaningful barrier to finger rubbing of eyes, nose, and mouth, and indeed may actually increase finger-touching to the face to constantly adjust the uncomfortable placement of the face mask. Face masks also exacerbate penetration of virus with significant negative air pressure (breathing in effectively "sucks" or pulls particles on the front of the face mask or in the air near the mask directly through the mask fabric) and positive air pressure (breathing or coughing or sneezing out that forcefully propels particles through the mask fabric).

Put more simply, face masks positioned directly over mouths force the wearer to suck virus in through the fabric by inhalation or expel it out forcefully by exhaling or coughing or sneezing. Clear face shields alone block little or no air flow—and therefore virus-sized particles—to mouth and nose, and also still allow fingers to rub eyes and nose and mouth under and around the shield. Also, face masks are nasty and unpleasant (they accumulate mucus and spit and moisture), are uncomfortable and even painful (they often hurt the ears) to wear over long periods, may actually impair breathing for some individuals, and are very, very easy to pull down and defeat, even subconsciously. Therefore, compliance levels for face masks are sub-optimal.

As can be seen, there is a need for a solution to one or more of these problems.

SUMMARY OF THE INVENTION

In one aspect, personal protection equipment (PPE) virus protection headwear apparatus of the present invention provides a hat/shroud combination which when worn may reduce transmission of small virus-sized particles and may help to significantly limit the transmission of viral and bacterial infection in high, medium, and even low exposure environments.

In one aspect, the PPE virus protection headwear apparatus may solve the problems of: face masks and face shields which leave gaps to allow infection in and out around the face mask or face shield; face masks and face shields which do not protect eyes from particles; face masks and face shields which do not offer meaningful barrier to finger rubbing of eyes, nose and mouth; and face masks that are easy to defeat by removal or adjustment, even subconsciously.

In another aspect, the PPE virus protection head wear apparatus may solve the problem of face masks which assist penetration of virus with significant negative (breathing in) and positive (breathing or coughing or sneezing out) air pressure; and further solves the problem of face masks which when positioned directly over mouths force the wearer to suck virus in through the face mask fabric by inhalation or expel it out through the face mask fabric forcefully by exhaling or coughing or sneezing.

In another aspect, the virus protection head wear apparatus may make it easier for some users to breathe without discomfort or difficulty by removing the fabric away from the mouth.

In a still further aspect, the PPE virus protection headwear apparatus of the present invention may solve the problem of clear face shields alone blocking very little airflow and also still allowing fingers to rub eyes and nose and mouth.

In an additional aspect, the PPE virus protection headwear apparatus of the present invention may solve the problem of face masks being nasty and uncomfortable to wear over long periods, and therefore the associated problem of sub-optimal compliance levels.

In one aspect, the PPE virus protection headwear apparatus may provide significant—although not necessarily perfect—360-degree protection for airborne aerosolized and droplet particles, may prevent accidental or intentional face rubbing contamination, and may eliminate extreme positive and negative air pressure differentials that can breach fabric protections. In a still further aspect, the PPE virus protection headwear apparatus in accordance with the present invention may provide a comfortable, effective PPE solution which will be worn more often and for longer periods of time than face masks or face shields.

Although embodiments of the present invention are intended to have application to a broad range of biological and other contaminants, including, notably, viruses, the invention was conceived in the midst of the ongoing COVID-19 pandemic, as of the filing date of the present invention, and the prevention of the spread of COVID-19 is therefore a clear, immediate and urgent example of use of the present invention.

These and other features, aspects and advantages of the present invention will become better understood with reference to the following drawings, description, and claims.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, without departing from the scope of this disclosure.

DETAILED DESCRIPTION OF THE INVENTION

Figure 1:
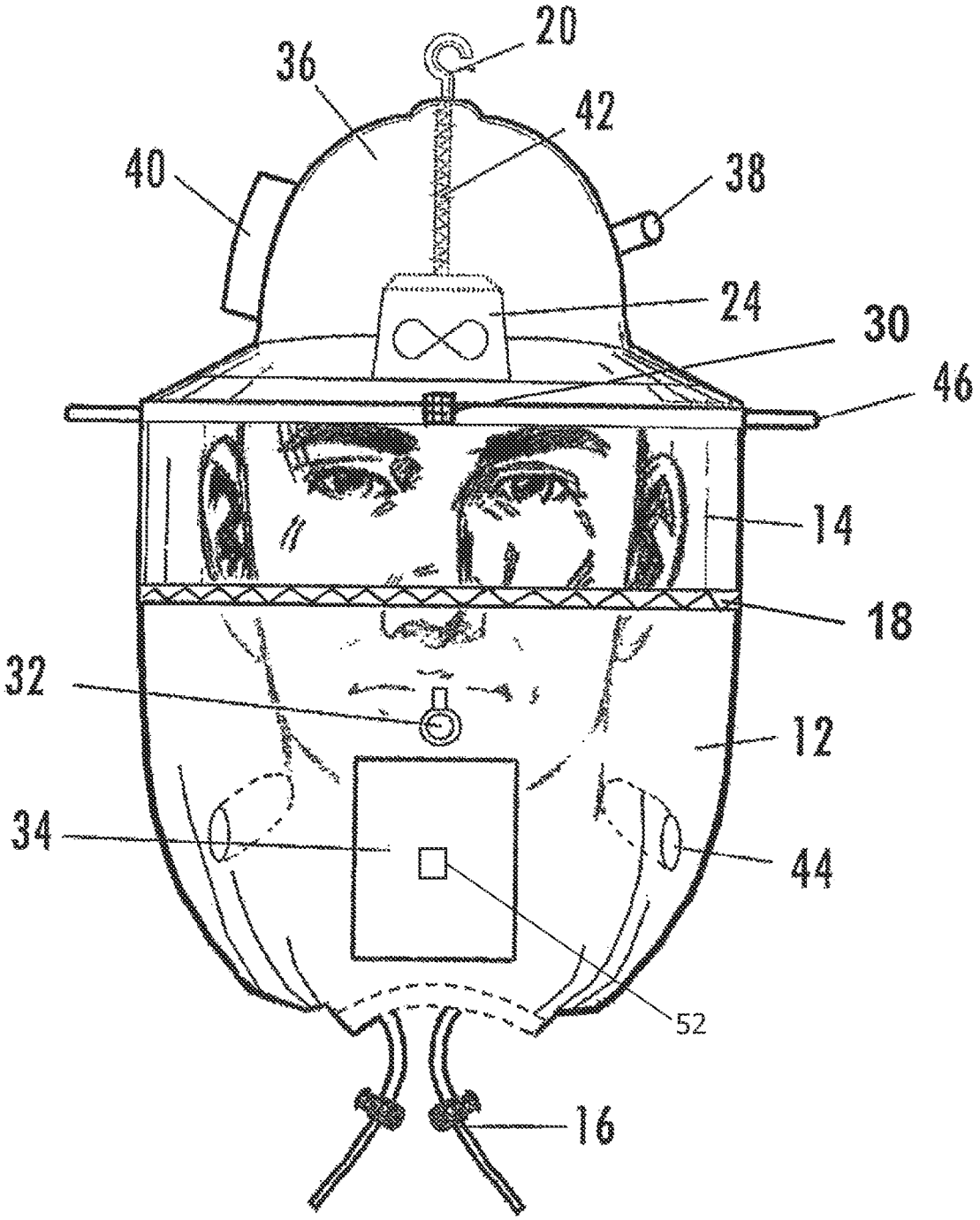
FIG. 1 is a front view of a first embodiment of the present invention, shown in use with a helmet.

The subject disclosure is described with reference to the drawings, wherein like reference numerals are used to refer to like elements throughout. In the following description, for purposes of explanation, numerous specific details are set forth in order to provide a thorough understanding of the present disclosure such that one skilled in the art will be enabled to make and use the present invention. It may be evident, however, that the present disclosure may be practiced without some of these specific details.

Broadly, an embodiment of the present invention provides a virus-sized particle protection apparatus, and a personal protection equipment (PPE) virus protection headwear apparatus.

The present invention is directed to personal protection equipment (PPE) which may allow individuals to move around relatively more freely and more safely in an environment characterized by risk for viral and bacterial contamination (e.g. more crowded indoor public spaces, aircraft cabins, medical facilities, etc.), with significantly reduced risk of infection from both airborne droplet or aerosolized particles (via breathing) and via face touching fomite contamination, when compared to face masks, face shields or other PPE.

The present invention may also significantly reduce airborne and fomite particle transmission "outward" to the air or surfaces via heavy breathing, sneezing, coughing, etc. from the wearer to others and to the environment.

The present invention is not presently intended exclusively as a medical device requiring any regulatory approvals, and the present invention is not yet presented with any specific claims by its inventor regarding the blockage of any particular percentage of any specific viruses, bacteria or other particles of any particular size (in part, the blockage percentage of any given size of particle will be determined by, among other variables, the choice of fabric for the shroud, forcefulness of breathing/coughing/sneezing, and by environmental factors such as air flow and ventilation, etc.). However, it is contemplated that the invention could and would be submitted to the Food and Drug Administration (FDA) and other similar governmental agencies to be approved for medical claims related to the prevention of the spread of, for example, COVID-19.

The present invention is also intended to be affordable enough for widespread ownership and use, with a target cost for the most feature-filled variation with all embodiments under $100, and perhaps under $50 (ideally under $25), and under $5 for the one-use, fold flat, disposable variation of the invention. The mid-range variation would fall into a cost range between the other two variations.

As stated hereinabove, the PPE virus protection headwear apparatus of the present invention may help significantly limit the transmission of both airborne and fomite viral and bacterial infection in all exposure environments. The PPE virus protection headwear apparatus of the present invention may provide a better head- and face-covering solution than face masks because it totally encloses the head 360 degrees, sealing around the neck, and therefore may close most or nearly all the gaps that allow potential infection-sized particles in, substantially reduces nearly all the ways infection can be transmitted out, and is much more comfortable to wear than face masks, so it is therefore more likely to be used. Additionally, the PPE virus protection headwear apparatus of the present invention may provide far better protection for high danger zones such as enclosed spaces with crowds, theme parks, movie theaters, churches, sporting events, airplanes, medical facilities, etc.

The PPE virus protection headwear apparatus of the present invention differs from and distinguishes over what currently exists in design, intent of use, configuration, features, etc. The PPE virus protection headwear apparatus of the present invention may cover a much larger area, completely encapsulating the head, and therefore makes particle penetration and accidental manual defeat (finger touching) much more difficult as compared to masks or simple shields.

The PPE virus protection headwear apparatus of the present invention has 360-degree protection for airborne droplet particles or aerosolized particles, prevents accidental or intentional face rubbing contamination from fomites, eliminates extreme positive and negative air pressure differentials that can breach fabric protections, and is comfortable and will therefore be worn more.

Referring now to the Figures, exemplary embodiments of the virus protection headwear apparatus are shown:

FIG. 1 provides a front view of an exemplary embodiment of the present invention in which a hat/shroud combination may be associated with any suitable type of relatively or mostly rigid headwear, such as, for example and without limitation, a pith helmet type hat (as shown).

Figure 2:
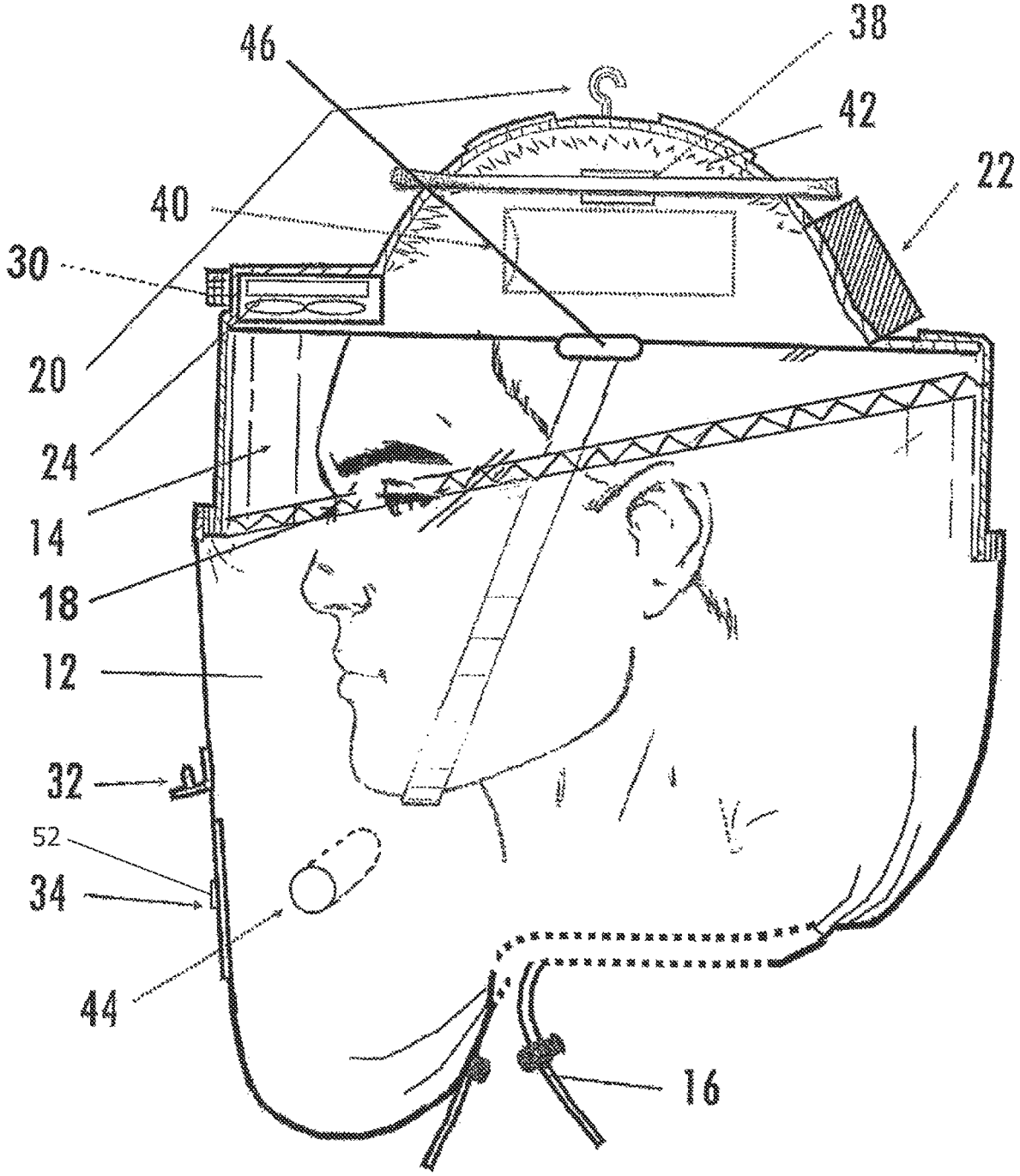
FIG. 2 is a side view of the first embodiment of the present invention, with portions cut away to show various components thereof.

FIG. 2 provides a cross-sectional side view of an exemplary embodiment of the present invention also shown in FIG. 1, showing additional detail of various optional parts and features further described herein for a pith helmet type hat variant.

Figure 2A:
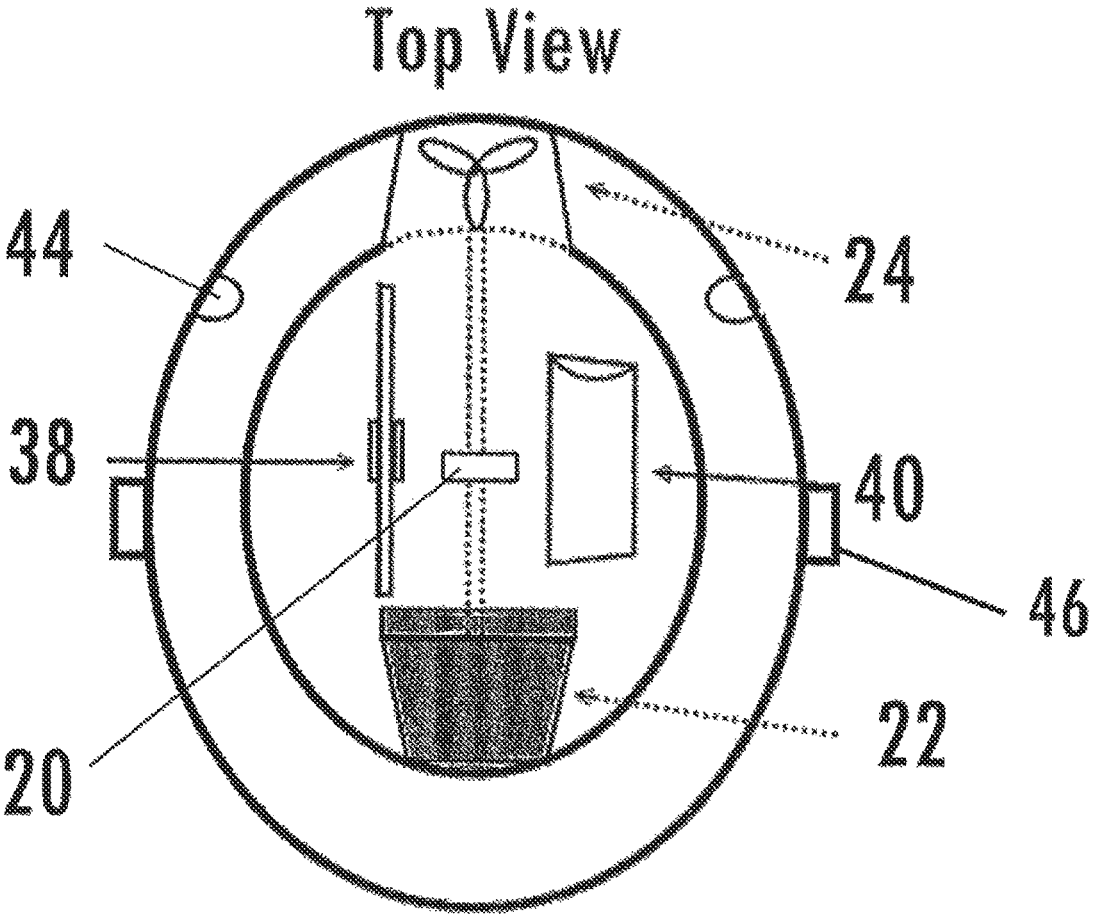
FIG. 2*a* is a top plan view of the first embodiment of the present invention.

FIG. 2*a* provides a top view an exemplary embodiment of the present invention in the pith helmet type hat variant also shown in FIGS. 1 and 2, also with various optional parts and features shown.

Figure 3:
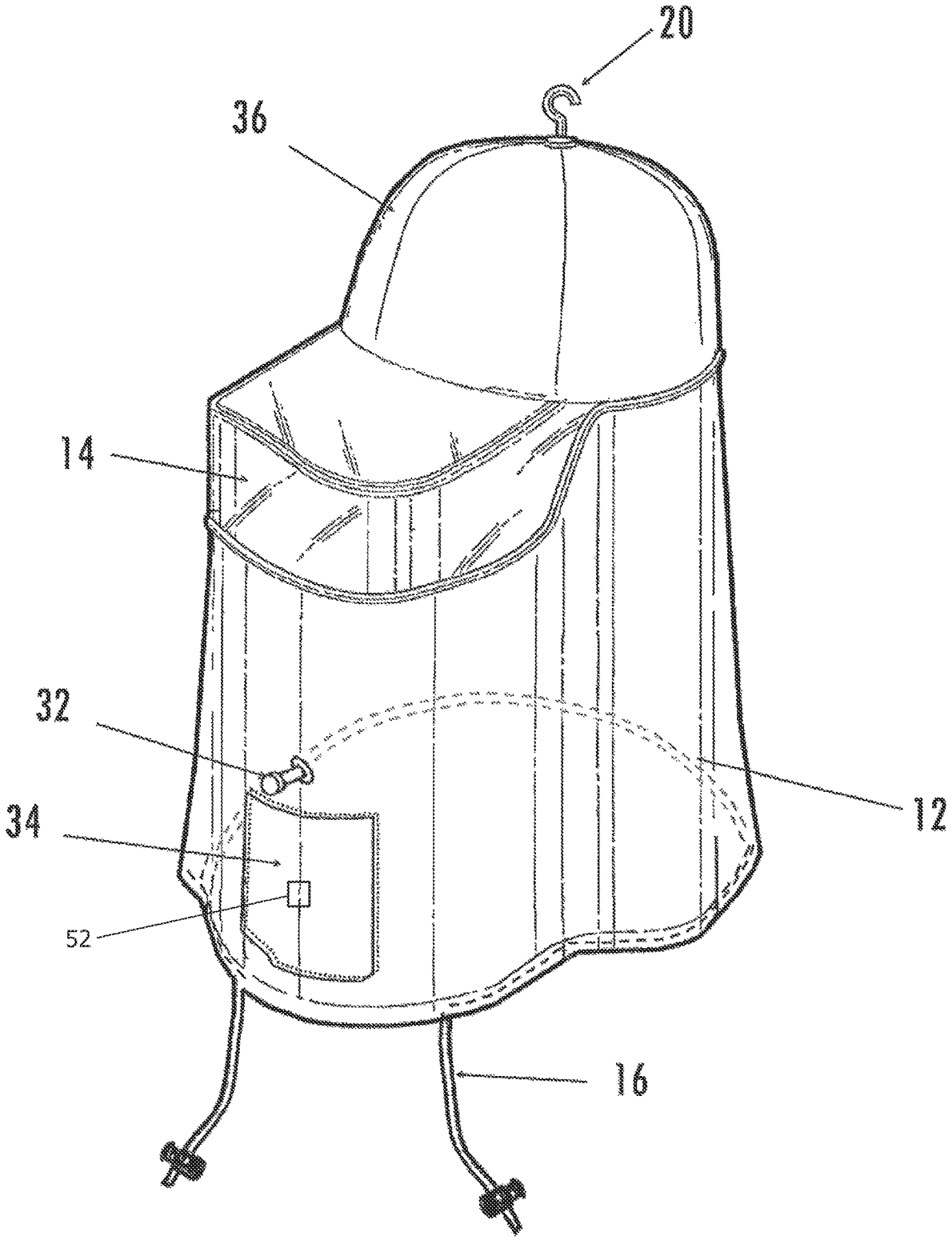
FIG. 3 is a perspective view of a second embodiment of the present invention, shown in use with a brimmed cap (e.g., a baseball cap)

FIG. 3 provides a perspective view of an exemplary embodiment of the present invention, in which a hat/shroud combination may be associated with any suitable type of headwear, such as, for example without limitation, a baseball cap.

Figure 4:
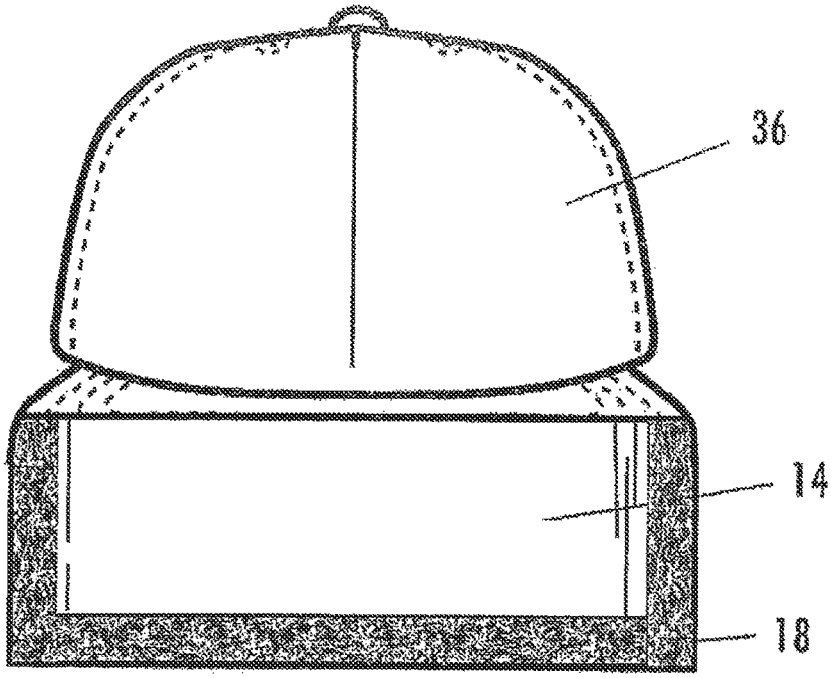
FIG. 4 is a front view of a visor attachment of a third embodiment of the present invention, shown in use with the brimmed cap.

FIG. 4 provides a front view of a visor attachment component (accompanying shroud not shown) of an exemplary embodiment of the present invention designed for use with a user's own baseball cap by slipping over and encapsulating the brim of the user's own baseball cap.

Figure 5:
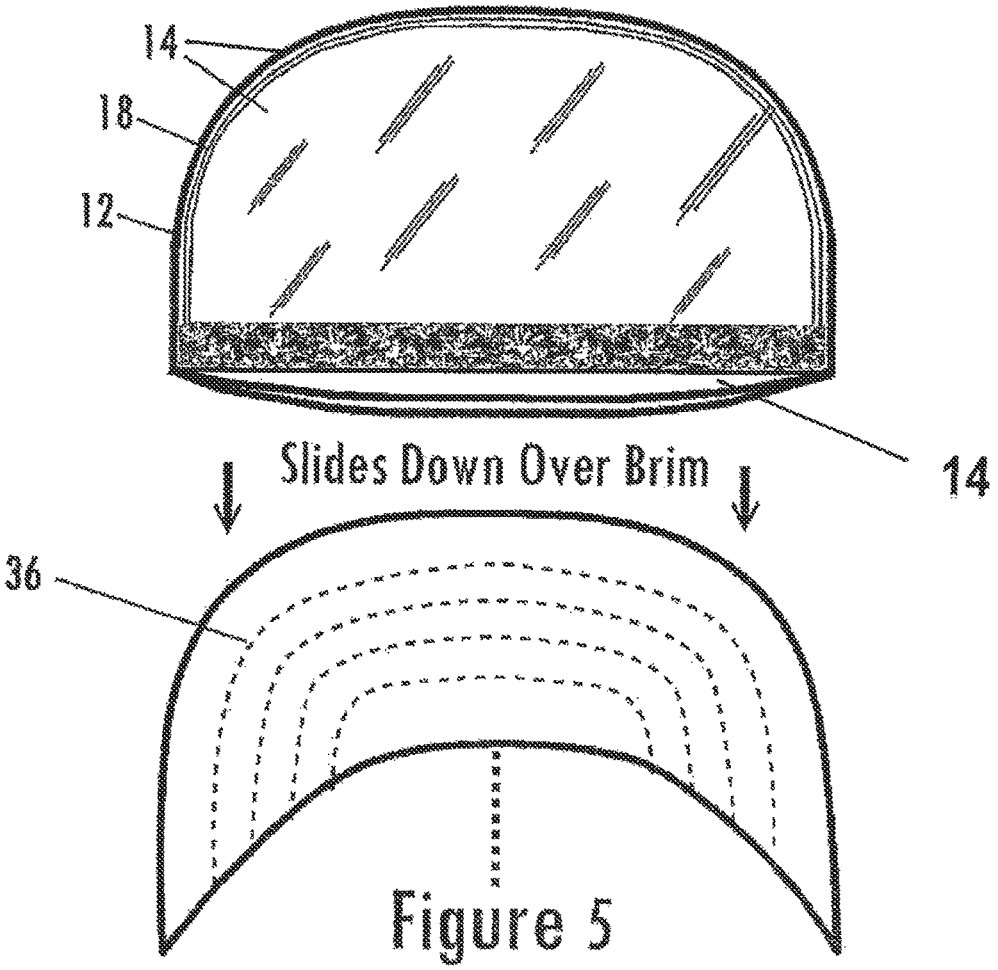
FIG. 5 is a top view of the visor attachment of the third embodiment of the present invention, shown in use with the brimmed cap.

FIG. 5 provides a top view of an exemplary embodiment of the present invention in visor attachment form (accompanying shroud not shown), illustrating how it would slide over and encapsulate the brim of the user's own baseball cap.

Figure 6:
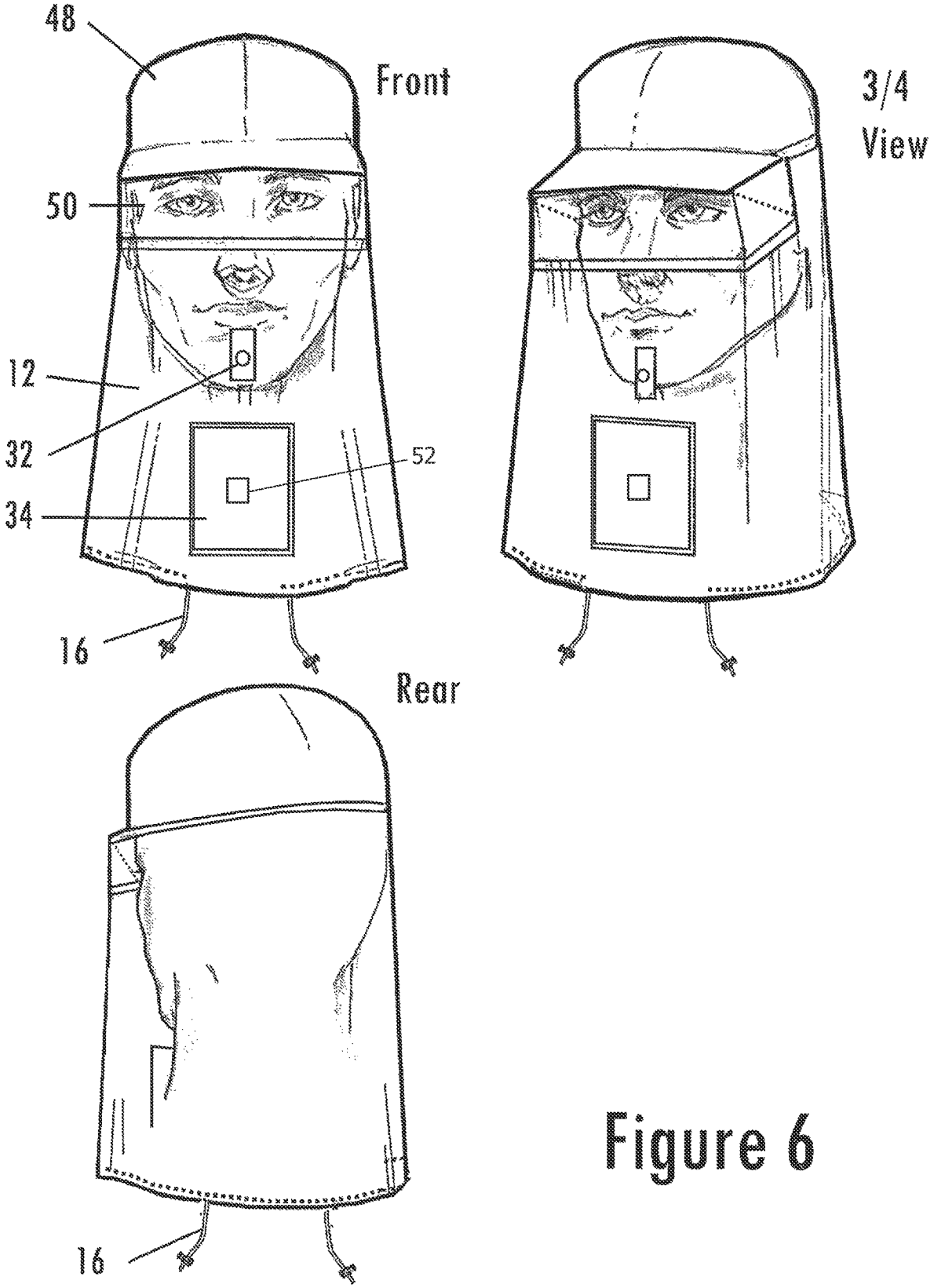
FIG. 6 is a front elevation view, front perspective (¾) view, and rear perspective view of a fourth embodiment of the present invention.

FIG. 6 provides a front, ¾ and rear view of an exemplary embodiment of the present invention in a disposable, fold-flat, one-use variant in the general shape of a baseball hat.

Figure 7:
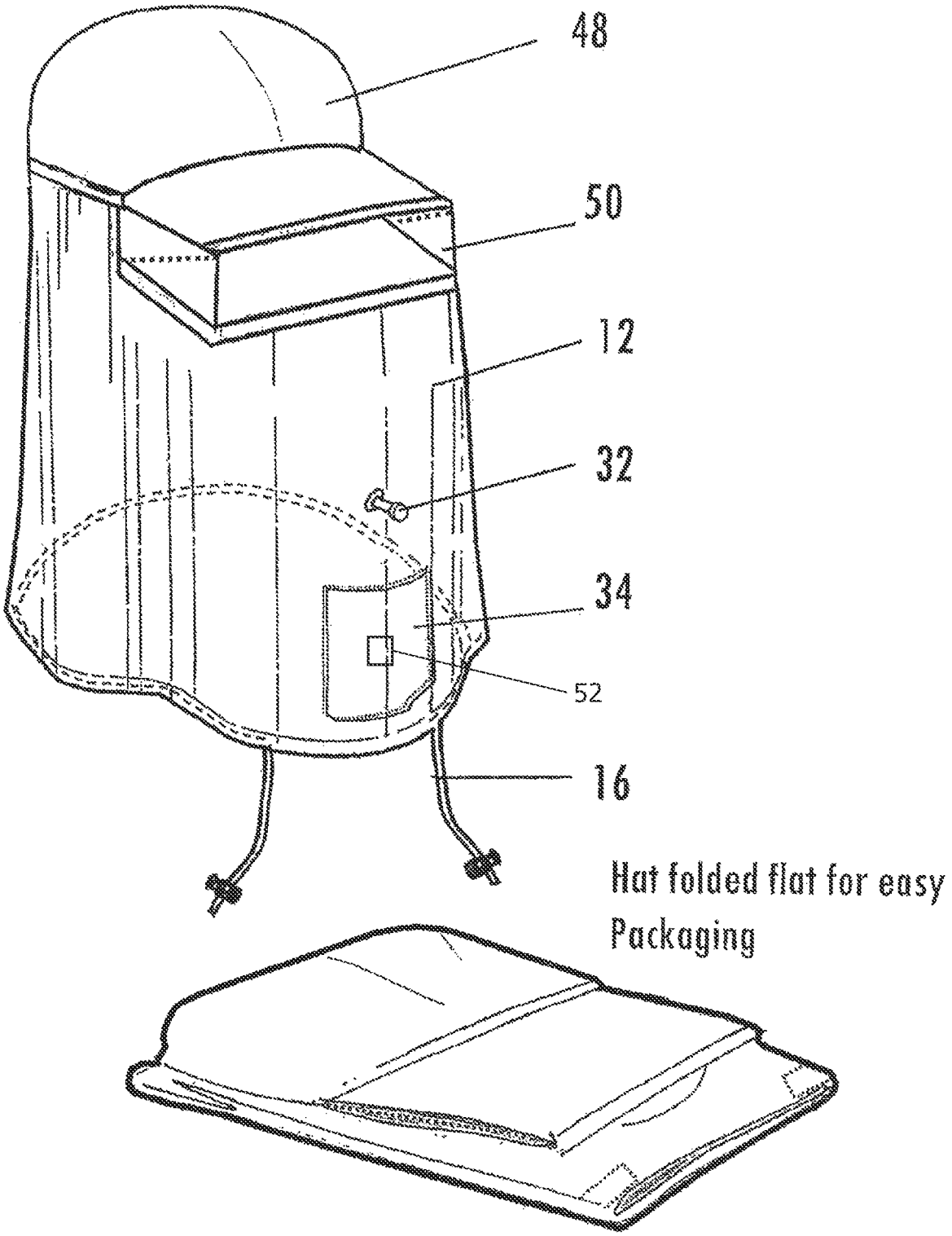
FIG. 7 is a perspective view of the fourth embodiment of the present invention, shown in use with a cap (top image) and folded flat (bottom image)

FIG. 7 provides another ¾ view, and a folded flat view, of an exemplary embodiment of the present invention in a disposable, fold-flat, one-use variant in the general shape of a baseball hat.

Figure 8:
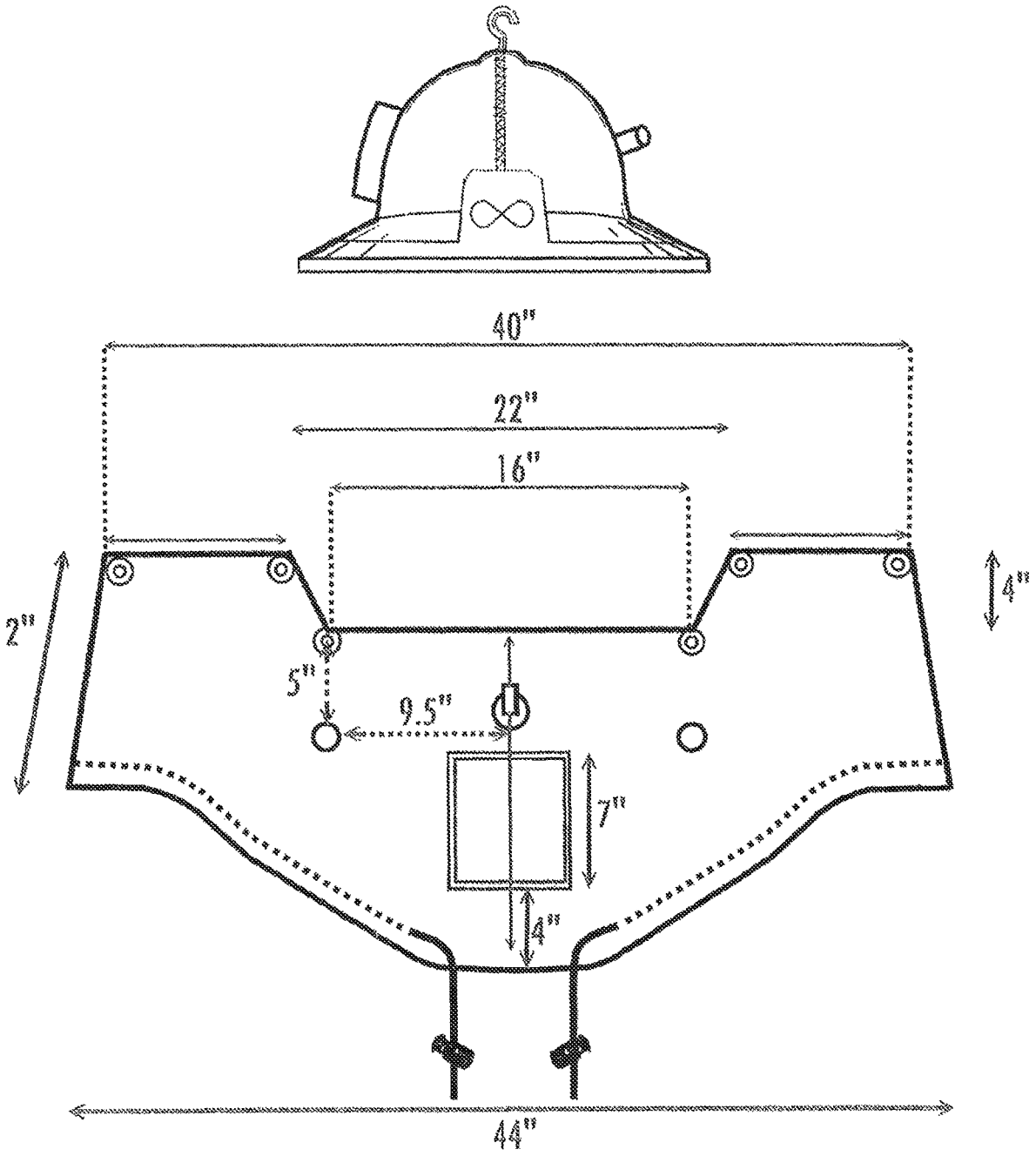
FIG. 8 is a front view of an exemplary shroud layout in accordance with embodiments of the present invention in use with the helmet.

FIG. 8 provides a fabric pattern plan view of an exemplary embodiment of the present invention with respect to the fabric shroud designed to be connected to the pith helmet hat variant also shown in FIGS. 1, 2 & 2*a*. It will be appreciated that the dimensions are approximate, only intended for illustrative purposes, and may change for a variety of reasons.

Figure 9:
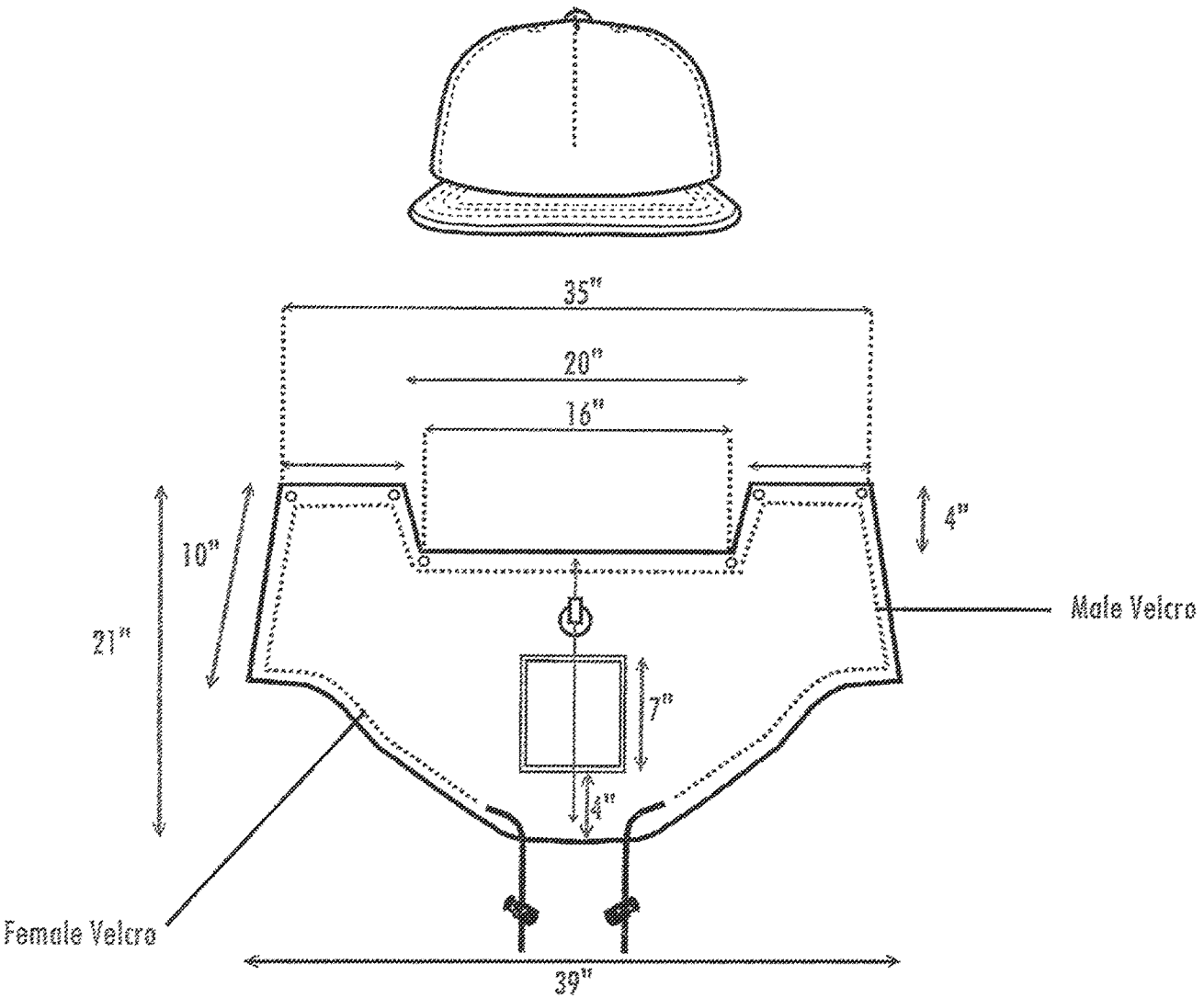
FIG. 9 is a front view of an exemplary shroud layout in accordance with embodiments of the present invention in use with the baseball cap.

FIG. 9 provides a fabric pattern plan view of an exemplary embodiment of the present invention with respect to the fabric shroud designed to be connected to the baseball hat variant also shown in FIG. 3. It will be appreciated that the dimensions are approximate, only intended for illustrative purposes, and may change for a variety of reasons.

With reference to FIGS. 1-9, in an exemplary embodiment, the personal protection equipment (PPE) virus protection headwear apparatus of the present invention may comprise the following components: (1) a hat that includes an integral clear viewing shield across the front and along portions of the side; (2) a shroud; and (3) a connector to connect the hat and the shroud.

In some embodiments, the connector for the hat and the shroud may comprise a mainly horizontal mechanism to connect the bottom of the hat to the top of shroud. The connector may be airtight, lightweight, hard to accidentally pull off, and cost-effective. The connector may comprise any suitable connector, such as, for example without limitation, an airtight zipper, hook and loop fastener strips, sandwich/freezer bag type "zip lock/pinch close" seals, metal or plastic "snap" closures, or combinations thereof.

In some embodiments, the PPE virus protection headwear apparatus of the present invention may further and optionally comprise one or more of the additional elements: (i) one or more small internal cooling fans powered by USB rechargeable/easily interchangeable battery pack and/or solar/light panels; and (ii) one or more proximity sensors which operate in combination with one or more wristbands to sound an alarm and/or vibrate to warn of attempts to inadvertently penetrate the hat and/or shroud.

In some embodiments, the hat and the shroud may be attached together with the connector. In some embodiments, the fan(s), battery, solar panel and proximity sensor(s) may be integrally provided with the hat, or permanently or removably attached to the hat.

In an exemplary embodiment, the PPE virus protection headwear apparatus may fully encapsulate the head of the user/wearer so as to absolutely minimize the entry or exit of COVID-19 virus sized particles, and may also prevent accidental hand contamination of the mouth, nose or eyes, even in environments where virus concentrations may be heavy in the air or on surfaces, while also providing reasonable comfort and visibility so that people will actually wear the apparatus.

In an exemplary embodiment, the hat and the shroud work together and serve different, important functions. The hat may provide the structure that lifts and holds the shroud AWAY FROM THE MOUTH, which is critical to (i) reduce the positive and negative air pressure forces on the shroud which increase particle penetration inward and outward, (ii) to make it easier to breathe, and also (iii) to reduce the extent to which the shroud becomes contaminated with mucus and spit and moisture. The hat may also support or incorporate or integrate as part of the hat as a single piece, or as an attachment, a clear visor or vision shield that allows users, even those who wear eyeglasses, to work and function fairly normally.

The fabric shroud may be designed to allow air in so that the user may breathe, while blocking and preventing harmful virus particles from entering, and further preventing the users from sucking in harmful virus particles, or from breathing out harmful virus particles into the environment.

The connector may comprise any suitable device to join the hat and the shroud, in a manner that provides ease of use and easy disassembly for separate washing and cleaning. The ability to wash and re-use the present invention is a critical design objective for the presently described embodiments, and is vital to effective use, in particular, during a pandemic when supply chains for other PPE options may be severely distressed.

In an exemplary embodiment, the hat may further comprise a top hat portion, and a hook (either attached or modeled or cast into the hat) located at the top hat portion which allows the user/wearer to easily remove the hat using just 2 fingers. While not in use, the hat may then—using the hook—easily be hung on a hanger, hook or placed on a hat rack, to avoid contamination on surfaces.

In some embodiments, the shroud may further comprise include an open and closeable straw hole located proximal to the mouth area which may allow the user/wearer to drink through it while working with very minimal breach of particles.

In some embodiments, the shroud may further comprise an "impermeable zone" located below the mouth area which may be raised by the user to the user/wearer's mouth to prevent coughs or sneezes for pushing or expelling virus through the shroud. The impermeable zone of the shroud may also be equipped with a structured plastic or rubber frame designed to contain a number of layers of fabric or paper tissues, whereby each tissue after being used to absorb/contain a cough or sneeze may be then removed from an open-and-close slot at the bottom or side of the framed area, so that a clean tissue remains behind it for the next sneeze or cough.

In some embodiments, extra slack in the shroud may allow the users to scratch their faces using the shroud without penetrating it with particles.

In some embodiments, the shroud may also contain small impenetrable notched areas on either side of the front or side of the shroud that a finger would insert into to facilitate zero-contamination face scratching or rubbing through the shroud with particle penetration.

In some embodiments, the bottom of the shroud may also "flare out" to be wider than the top of the shroud, and may also contain a very light partial structural component band or ring (in a manner similar to a "hoop" on a dress) so as to allow easier placement and removal of the invention without excessively rubbing on face or skin.

In most embodiments and design variants, except only for the disposable, fold-flat, one-use variant, the shroud will be made of a material that is designed to be somewhat durable and machine washable, as well as removable, to facilitate washing and re-use.

In embodiments providing all of these features, the PPE virus protection headwear apparatus may provide maximum protection, reasonable comfort, reasonable usability and reasonably easy cleaning. In some embodiments, two or more shrouds may be provided with every invention to facilitate having a clean shroud at all times.

The hat portion may be made in the same manner as any rigid, hard type of hat such as a pith helmet, hard hat, bike helmet, welder mask, or the like. The hat portion may be made of any suitable material by any suitable process, such as, for example without limitation, injection molded, sprayed, cast, 3D printed or combinations thereof. The hat portion of the more rigid pith helmet type variant would optimally be produced with the clear eye shield as an integral part of the hat (as a single piece), but the clear eye shield could also be attached separately. The hat portion of the pith helmet type variant may also incorporate two extended tabs on either side of the hat to make it easier to lift the hat straight up off the user's head.

The shroud portion may be made of any suitable fabric, and may comprise a sewn piece of fabric—or layers of fabric as recommended and informed by particle penetration testing—having a top shroud portion to which the connector is attached to connect to the hat, and a lower shroud portion including a lower neck opening with a drawstring or one or more cinch ties or Velcro ties provided at the lower shroud portion to tighten the shroud around the user/wearer's neck.

In one embodiment, the PPE virus protection headwear apparatus may comprise as essential components, the hat, the shroud and the connector, as complete protection may not be provided without all of these elements or components acting together in concert to provide optimal particle protection, reasonable vision, reasonable comfort, high compliance rates, ease of placement and removal and ease and convenience of cleaning.

In other embodiments, one or more of the following optional components and combinations thereof may be included: the straw hole on the shroud, the impermeable zone on the shroud (with or without insert for removable layers of tissues), at least one cooling fan located in the interior of the hat, a power source associated with the fan, at least one solar panel on an exterior portion of the hat, batteries or easily replaceable battery pack located attached to the outside of the hat, a place to attach lightweight container(s) for straws and/or gloves, and a proximity warning sensor (and accompanying wristbands) associated with the hat.

In some embodiments, the PPE virus protection headwear apparatus may comprise a hat with structural variations constructed and arranged for different uses. For example, the hat similar to a "baseball cap", without a back brim and back shield, may be suitable for flying on airplanes or riding in motor vehicles so the user/wearer may lean the head back against a headrest without knocking the hat off or destabilizing the hat.

In some embodiments, the PPE virus protection headwear apparatus may comprise a baseball cap version of the hat which may be simpler and cheaper to manufacture, but may also leave fabric closer to the head most of the way around. The shroud fabric material may change depending on the use conditions, environment and availability.

In some embodiments, use in highly hazardous environments may require a shroud which comprises a more impermeable fabric, and may require including a separate additional, optional ventilation filter, but the apparatus is not primarily intended for use with heavy, expensive, and cumbersome active filtration devices.

To use the PPE virus protection headwear apparatus, the user simply needs to lower a completely assembled and attached hat/shroud onto the head, cinch, snap, pinch, Velcro or otherwise close the shroud portion around the neck, and then proceed with much higher confidence against virus infection in crowded places, airplanes, hospitals, or the like. If everyone in a given environment wore one or another variant of the PPE virus protection headwear apparatus of the present invention, it may be exceptionally difficult for the Covid-19 virus or other similar-sized biological contaminants to spread.

The PPE virus protection headwear apparatus of the present invention effectively addresses the only two known meaningful sources of virus spread: (1) coughing/sneezing/breathing virus-sized particles in the air; and (2) touching contaminated surfaces, then touching the face. The PPE virus protection headwear apparatus of the present invention may provide a hat/shroud combination which blocks BOTH sources of virus spread. In one aspect, the present invention may comprise various combined elements of a welder's helmet, a pith helmet, a visor, a hazmat shroud or suit, goggles, and a beekeeper's helmet, or the like. In an exemplary embodiment, the present invention is directed to a virus protection apparatus which may comprise a hat, a shroud, and a connector element for connecting the hat and the shroud.

In some embodiments, the virus protection apparatus of the present invention may comprise these three elements as the essential components. In other embodiments, the present invention may comprise a hat, a shroud, a connector element for connecting the hat and shroud, and additional optional equipment that may be added for additional comfort or utility.

In some embodiments, the hat and shroud may be made of a much cheaper, disposable, flat-folding, one-use paper/inexpensive cloth permanently affixed to each other in the general shape and configuration of a baseball cap with a clear inexpensive cheap rigid plastic visor shield in front, all as a single continuous piece sewn or taped or glued together, without the ability to remove the shroud from the hat. Such a one-use, single piece, disposable embodiment would still contain an open and closeable straw hole and an impermeable "cough zone" in the front of the shroud, but likely not the other optional features. This disposable embodiment would be intended particularly for airline passengers, moviegoers, sporting event attendees, concert attendees, hospital visitors and others who may find themselves in a high virus exposure environment for extended times.

The following Parts 1-3 are described primarily in the context of the first embodiment (FIGS. 1-2*a*) which, in the marketplace, would be a higher end version/embodiment of the present invention. However, references to the other embodiments will also be made, as appropriate, to educate those with skill in the art various ways in which the present invention may be practiced.

Part 1: The Hat.

With reference to the Figures, in some embodiments, the hat 36 may be any suitable hat which may be constructed and arranged for use with the shroud and connector element. In an exemplary embodiment the hat 36 may comprise a single-piece, rounded (with flat brim), impermeable or slightly breathable clear plastic hat 36 generally in the shape of a "pith helmet" (e.g., FIGS. 1-3), except that where the brim ends on the exterior of the hat 36 all the way around, the plastic continues and takes a 90 degree downward curve approximately 3.0"-4.5" below the brim (wider for certain applications requiring user to look down extensively) to form a 100-150 degree arc visually transparent shield 14 on the front of the hat 36 for optimal forward and peripheral vision of the user/wearer. See, for example, FIGS. 1 and 2. As will be appreciated by those with skill in the art, the shape and position of the lower edge of the shield 14 may be varied by use so as to increase peripheral vision, to simplify attachment of the shroud, or for other reasons.

The top of the hat 36 may comprise a molded or attached hook 20 or loop (oriented front to back with hook opening on the back side) constructed and arranged to allow the user/wearer pull it off the user/wearer's head with two fingers and then hang it up easily on a hook or set it on a hat stand with the shroud 12 hanging downward, and then it may be replaced back on the user/wearer's head with two fingers with minimal contamination. The two sides of the hat 36 might have similar integral loops, tabs 46 or hooks extending slightly to the side to allow the user to grasp the sides of the hat 36 with two hands and lift it up and off more easily than removing from the top.

In an exemplary embodiment, for comfort and stability, the inside of the hat 36 may comprise molded attachment points to receive a snap-in and easily removable/replaceable, "off-the-shelf adjustable" "helmet-type" or "hard hat type" headband and chin strap comparable to a standard hard hat, bicycle helmet or other similar hard hat or helmet. In an exemplary embodiment, the hat 36 may be constructed and arranged to be not only comfortable on the user/wearer's head, but also to separate the hat material from the head to support air circulation via adjustable head attachment, and may also feature a chin strap to prevent the hat from easily moving or falling off the head.

In an exemplary embodiment, the hat 36 may be provided in different sizes for different-sized heads (kids, men, women, etc.). In some embodiments, the typical adult hat may have a diameter of approximately 13" exterior brim to exterior brim. In some embodiments, the hat may also be somewhat oval (longer front to back) instead of exactly round.

In an exemplary embodiment, the hat 36 may be made of any suitable material and fabricated by any suitable process. In some embodiments, the hat 36 may be made of any type of material which is relatively lightweight but also relatively rigid, such as a plastic material. In some embodiments the material of which the hat 36 is made may be transparent plastic. In an exemplary embodiment, the hat 36 may made by any suitable process, such as, for example without limitation, injection molding, three-dimensional (3D) printing, casting, or the like. In some embodiments, the manufacturing process is not critical.

In some embodiments, the hat 36 may provide optional cranial impact protection for applications and uses which require hard hats or additional protection. In other embodiments, where cranial impact protection is not required or needed, the hat will not provide such features.

In some embodiments, the hat 36 may comprise the feature of "breathable inserts" on portions of the hat for ventilation, albeit with very high resistance to particles of the size of aerosolized COVID-19 viruses. A hard or rigid, easily-cleanable-with-a-surface-cleaner, but still breathable material which is capable of resisting virus-sized particles would be ideal, though the inventor is not aware of a material meeting all these requirements at the time of this writing. In some embodiments, for simplicity and lowest cost, and to minimize any air/particle breach, the entire hat 36 would ideally be a single molded or shaped piece, with optional ventilation inserts.

In other embodiments, the virus protection apparatus of the present invention may comprise the 100-150-degree vertical transparent shield 14, and an existing hat 36 constructed and arranged for attachment of the 100-150-degree vertical transparent shield 14 to provide an airtight or nearly airtight seal between the shield and the hat (a 360-degree plastic shield is a possible embodiment, but is not likely to be necessary for vision for most purposes, and also a 360-degree shield increases heat build-up and may rub on shoulders or neck). The hat 36 may comprise any existing hat provided the airtight or nearly airtight seal may be provided. In some embodiments, the clear plastic crown of the hat 36 and brim may be spray painted or covered with any suitable material, provided the vertical shield portion 14 of the hat 36 remains transparent.

In some embodiments, the bottom of the hat 36 would have a connection zone or strip along the bottom of the vertical shield 14 further comprising any suitable connector for attachment of the shroud 12 thereto. In some embodiments, the connector may provide a mating connection with a connector provided on the shroud 12 for connection of the hat 36 to the shroud 12. See, for example, FIG. 8. Any suitable connector 18 may be provided, such as, for example without limitation, one or more of [airtight] zipper tape, hook, and loop fastener strips, "freezer bag" pinch closures, snaps or other mechanisms, and combinations thereof. Again, the shroud 12 may have a mating connector at a top portion thereof (see the description of the connection concerning the shroud 12, hereinbelow).

In some embodiments, the hat 36 may optionally be provided with at least one USB-chargeable powered fan 24 and or replaceable-battery-pack powered fan and/or solar panel-powered fan for comfort (i.e., the cooling fan 24 is provided for convection purposes, not for breathing purposes). As shown in FIG. 2, the fan 24 does not need to be associated with an air inlet, or the like, because it's primary purpose is to circulate air (and not pump in outside air for breathing purposes). In some embodiments, the at least one fan 24 may comprise a plurality of fans. In some embodiments, a solar panel may be affixed to the top of the hat 36. In some embodiments, the fan would be powered by a battery back 22 that may be a USB rechargeable battery pack or an easily replaceable battery pack, attached to the outside of the hat 36, or any or all of the same. The battery pack 22, as shown in FIG. 2, may be connected to the fan 24 via a connecting wire 42.

In some embodiments, the hat 36 may optionally be provided with a proximity sensor 30 on the lower brim of the hat 36 that would alarm or buzz when a hand wearing a mated with optional wristband sensor (one for each wrist) came too close. This option may provide an additional level of protection/security to the user/wearer.

In some embodiments, the hat 36 may optionally be provided with additional portions of breathable material, to increase the surface area of breathable material vs. non-breathable hard or rigid hat material portions. For example, a clear vertical shield area 14 below the brim of the hat may be limited to the front 100-150 degrees of the hat 36 and the back 210-260 degrees of the hat 36 may comprise fabric 12 attached to the bottom of the brim. See, for example, attached FIGS. 1 and 2.

In some embodiments, the hat 36 may comprise a back portion with little or no brim so that a user/wearer may lean back against a headrest without knocking the hat off or pushing it forward out of place, for example in a motor vehicle or an airline seat. See, for example, the embodiments of FIGS. 3, 6 and 7.

In some embodiments, the hat 36 may comprise a top portion which may be formed as a "lattice-like superstructure frame" over which a breathable but virus resistant fabric could be stretched for additional ventilation performance. Said lattice-like portion would include the protective vertical eye shield area.

In some embodiments, the hat 36 may be equipped on the exterior top with simple holders 38, 40 for straws (holder 38) and for surgical or other very thin gloves (holder 40) for easy access by the user to hydration and hand protection. In some embodiments, the holders 38, 40 for straws and gloves would be made of very lightweight, very thin "rubber" or similar curved "cups" with open portions facing generally up into which straws and gloves may be "stuffed" in a slightly curved container so they are unlikely to fall out.

Part 2: The Shroud.

In an exemplary embodiment, the virus protection apparatus of the present invention may comprise a breathable, virus- and bacteria-resistant fabric "shroud" 12, constructed and arranged for removable, secure attachment to the hat 36 by a connection as described in Part 3 hereinbelow.

In some embodiments, the shroud 12 would hang loose away from the user/wearer's mouth at least 2.5 inches and, typically, 3-4 inches for maximum comfort. As shown, for example, in FIG. 2, this is achieved by the extension of the brim of the hat 36 away from the user's head to approximately the desired spacing of the shroud 12, with the shield 14 hanging downwardly from a distal end of the brim and the shroud 12 hanging downwardly from the shield 14. This separation away from the mouth is an absolutely key component of the present invention for at least, but not limited to, three reasons: (i) by separating the particle-resistant fabric 12 well away from the mouth, the fabric 12 accumulates less mucus and moisture over wear time, making the present invention more comfortable and wearable for longer periods of time compared to conventional face masks (and therefore users are more likely to keep it in place for longer periods); (ii) the separation makes it easier for users to breathe and allowing more users to have PPE protection, and (iii) by separating the fabric 12 well away from the mouth, positive air pressure (from exhaling, sneezing, coughing, etc.) and negative air pressure (from inhaling) on the fabric 12 are dramatically reduced, thereby greatly reducing the process of "sucking particles in" by inhaling through the fabric 12 or "pushing them out" through exhaling (or coughing or sneezing) through the fabric.

In some embodiments, the internal lining at the bottom portion (e.g., one inch or so) of the shroud could be a different inlay or spray-applied material slightly "rubberized" or "gummy" surface, or a softer "fluffy" coating to provide a better, more complete seal, and also be more comfortable around the neck when closed tight.

In some embodiments, at the front and center portion of the shroud 12, generally at a point 1"-3" below where the user's mouth is located, the shroud 12 may further include and comprise an open- and closeable "valve" 32 similar to the air valve on an inflatable mattress or ball, or similar to a temporary peel and stick closure, or buttonhole with hook and loop closure, sized to allow a straw to pass therethrough for hydration. In some embodiments, the straw hole, once uncovered, would contain an aperture or flexible gasket or sphincter to accept different thickness of straws while clasping tightly around any typical size so as to minimize air penetration around a straw inserted through the straw hole.

In some embodiments, the shroud 12 can be made of any relatively breathable, washable, highly virus-sized particle resistant, soft fabric material. Nonlimiting examples of such fabrics may include a more breathable version of Dupont® Tyvek®, and/or a multi-ply 100% cotton with 1-2 chiffon or silk layers in between, or some other material or combination of materials that evolving research indicates may provide a high degree of virus-sized particle resistance, breathability, washability, and comfort.

In some embodiments, the shroud 12 may be sewn, cut, printed, or manufactured as a single, simple, rectangular, or trapezoidal piece (e.g., see FIGS. 8 and 9 with example dimensions). Depending on the size of the hat 36 and person wearing it, the shroud 12 may comprise dimensions anywhere from 30" long and 10" wide to 40" long and 18" wide. In some embodiments, the bottom area of the shroud 12 that would go around the neck would be 4-10" wider than the top, effectively "flaring out" at the bottom to make it easier for the user to slide over the head for wearing and removing embodiments of the present invention.

In some embodiments, depending on the connection mechanism selected, the shroud 12 may be a single flat piece that the user starts to attach at one point on the hat 36 (nominally and typically the back), then is connected gradually all around to the front and then completing in the back, where it must be sealed to the other end of the shroud 12 where it started along the vertical gap by means of a connection similar to or identical to the connection described herein below for connecting the hat 36 to the shroud 12.

In some embodiments, the shroud 12 might already be connected together by sewing or glue or tape as a continuous "circular" piece, not requiring closure of the vertical gap where the two ends of the shroud 12 meet (as stated above, typically at the back of the head). In such embodiments, the top of the shroud 12 would require flexibility to "stretch" around the hat 36.

In some embodiments, the bottom of the shroud 12 that goes around the neck may be fitted 75-100% of the way around with an extremely thin and very highly flexible wire or plastic "hoop" similar to the hoop on a hoop dress to ensure that the shroud flares out and away from the neck when users put the hat on and take it off, thereby reducing some contact with the shroud by the user's hands and neck and face in the process.

In some embodiments, a bottom portion of the shroud 12 may feature a "pull tight" closure cord 16 to or similar mechanism so that the bottom of the shroud 12 could be tightened around the neck for maximum particle blockage. In some embodiments, this closure for tightening around the neck would be a hook and loop fastener close or "snaps" or some other suitable closure mechanism.

In some embodiments, the virus protection apparatus may comprise a shroud 12 which may include enough loose/slack fabric to allow the user/wearer to scratch their face through the shroud without breaching the shroud fabric barrier. In some embodiments, and as shown in FIGS. 1 and 2, the shroud 12 would also contain two 1-2 inch deep, impermeable (via coating or additional particle-impermeable fabric) inserts 44 for fingers on either side of the front of the shroud 12 to facilitate easier face scratching through the shroud 12 without danger of contamination by pushing particles through the shroud 12.

In some embodiments, the shroud 12 would be breathable 360 degrees around over a total surface area of anywhere from 250 square inches to 550 square inches, and the user/wearer would not be "sucking air" only through a small surface area stretched directly over the mouth, so the shroud material may be somewhat more tightly woven, and therefore more particle impermeable, than a face mask located directly over the mouth.

In some embodiments, the virus protection apparatus of the present invention may be shipped/provided/sold with two or more shrouds so the shrouds may be machine-washed after each use, with at least one spare to wear while the other is in the wash.

In some embodiments, a lower end of the shroud 12 at a front portion thereof before and 1-6" under the mouth, and disposed below the valve 32 as shown in the Figures, may comprise an approximately 3"×3" to 5"-5" totally impermeable area "cough zone" 34 that a user may push against the mouth when the user coughs or sneezes, thereby even more significantly reducing, or completely eliminating, transmission of particles from the user through the shroud 12 to the general environment. In some embodiments, this cough zone 34 may be a sewn inlay of different fabric or a spray treatment to the existing fabric. In some embodiments, this cough zone 34 may also be attached by a hook and loop fastener with many extra pieces to be replaced and washed through the day in the manner of a handkerchief. In other embodiments, this cough zone 34 may comprise a rigid or flexible machine washable structure or frame permanently attached to the shroud, shaped, and curved to better cover the shape of the mouth and jaw, and also containing a disposable element, potentially in several layers of cloth or paper tissues to be removed through the day from an open- and closable-slot on the side or bottom. This will allow the user to cough or sneeze into the disposable tissue element of the cough zone 34, and then remove the used disposable tissue without removing the hat and without allowing particles to enter the invention easily, while also then exposing a fresh new disposable tissue layer underneath for the next cough or sneeze. In some embodiments, this cough zone 34 would feature a small fabric or plastic tab on the exterior of the approximate center of cough zone 34 to facilitate a user grasping the zone and raising it to the face in the right location by feel (as opposed to by sight) for a cough or sneeze. Reference number 52 in FIGS. 1, 2, 3, 6, and 7 illustrates such a tab, and is for general representation purposes only.

Part 3: The Connection Element Between the Hat and the Shroud.

In an exemplary embodiment, the virus protection apparatus of the present invention may further comprise a connection element 18 between the hat 36 and the shroud 12. The shroud 12 must be connected to the hat 36 by means of some connection mechanism so that the shroud 12 can be easily removed for washing and replacement as needed.

In some embodiments, the connection element 18 may comprise a mechanism which is (i) relatively easy to use relatively quickly, (ii) as air- and/or particle-tight as possible; (iii) not easily "tugged off" or separated accidentally and (iv) machine washable.

In some embodiments, the optimal connection element 18 is an air-tight and water-tight zipper, for example, without limitation, of the type manufactured by SZIP. However, other zippers might also suffice. In some embodiments, hook and loop fastener strips, metal or plastic snaps, magnetic connections, or "freezer bag" type "pinch tight" seals might also be used alone or in combination with each other for sufficient air-tight performance and resistance to accidental removal.

In some embodiments, a top portion of the shroud 12 may incorporate or include one side of the connection element 18, such as but not limited to: either the other half of a zipper tape, the other side of a hook and loop fastener strap, the other side of a pinch tight seal, or the male ends of male or female sides of snaps. In other embodiments if a zipper connection element 18 is used, the zipper tab would be on the shroud 12, not on the hat 36.

In some embodiments, the virus protection apparatus may comprise a similar airtight connection element 18 on both sides of the shroud 12 to connect in the back to form a complete seal 360 degrees around.

Simpler Variation Embodiment with a Baseball Cap

In an exemplary embodiment, and as shown in FIG. 3, the virus protection apparatus of the present invention may comprise a baseball cap shaped hat 36. A simpler variation of the invention may comprise a baseball cap 36 with a clear visor shield 14 attached to the brim thereof for a distance of approximately 2"-3.5" below the brim, with the shroud 12 attached to the bottom of the shield 14 and the bottom of the hat 36. Except for the shape, the shroud 12 would otherwise function in the same way and with the same features and connections as on the embodiments of the present invention disclosed hereinabove. In some embodiments, the apparatus of the present invention is installed on an existing baseball cap 36 owned by user.

One-Time-Use, Disposable, Fold-flat Embodiment

In an exemplary embodiment, and as shown in FIGS. 6 and 7, the invention may include a variant of the baseball cap variation described above, in the same general shape, appearance and configuration, except that the hat 48 and shroud 12, complete with clear visor 50 in front, would be produced as a single continuous apparatus (with no detachable components), permanently sewn or taped or glued together, and made entirely from the same inexpensive paper or fabric or paper/fabric hybrid (except for clear shield and straw hole closure), all of which would be able to fold flat into a total volume of approximately 8.5-11"×0.5" thick. In this disposable variation, the clear front shield 50 on the front of the hat brim directly in front of the user's eyes would be a rigid but very thin, very cheap piece of clear plastic or other clear material, however, the sides of the brim may be fitted with a more flexible plastic see-through material that connects to the rigid front-facing shield for enhanced peripheral vision, but can be folded to be flat, as shown at the bottom of FIG. 7). The overall intent of this variation is to be given in cheap plastic-sealed flat packs or sold at low cost to—for example only—airplane passengers, movie-goers, church-goers, concert attendees, sporting event attendees, gym patrons, bar patrons (note: straw hole for drinks), hospital visitors and others who venture into crowded, enclosed spaces with many other people, and who do not already have another variation of the invention or other PPE, or who have not brought it with them. As shown, the brim section of the hat 48 and the shield 50 have a squared off design to facilitate folding thereof (as shown at the bottom of FIG. 7).

Variation for use with the User's Own Baseball Cap

In an exemplary variation, and as shown in FIGS. 4 and 5, the present invention may be embodied in the form of a "sandwich" or "clam-shell" type of clear plastic construct with a gap area that is intended to slide over and around the top and bottom of the bill of any typical baseball cap 36, incorporating the rounded clear plastic shield 14 in the front as part of the same continuous piece, and to which a shroud 12 substantially similar to the shroud described elsewhere above for other variants, but in a different shape configuration, would be attached along the bottom of the vertical clear shield and all the way around including the top of the sandwich area, but with an additional area of the shroud—shaped in the general shape of a baseball hat 36 to go over the top of the baseball cap 36 and around down to the neck that a user pull on over the top of the hat 36. This exemplary variation would be partly held in place by "teeth" inside the clamshell, or a tight gap fit that "squeezes" the brim, but a significant portion of the holding in place would be provided by physical action of the shroud 12 going back over the hat 36 and holding the clam shell apparatus in place by shroud weight and tension over the top of the hat. In overall appearance, this variation would appear generally as a hood over the head and closing around the neck, with a clear plastic extension above the eyes in the location of the bill of the hat 36, with a vertical face shield incorporated.

SUMMARY

In summary, in exemplary embodiments, the virus protection apparatus of the present invention is constructed and arranged to provide nearly complete facial protection form (a) accidental or subconscious viral contamination by hand from contaminated surfaces, or (b) by breathing of aerosolized or droplet virus-sized particles, while simultaneously being more comfortable to wear than directly over-the-mouth face masks or other personal protection equipment (PPE). It would be extremely difficult to defeat the total 360-degree protection inadvertently or subconsciously. The user would have to physically undo the closure mechanism around the neck with their hands and then awkwardly reach a hand underneath in the gap in the shroud in order to access the face with hands. If the optional proximity alarm/vibration buzzer system were used, this would be nearly impossible to do unconsciously.

In addition, the virus protection apparatus of the present invention may make it much more difficult for a wearer to infect others around them or in close proximity. Further, the hat portion may also be easily sanitized. The hat may be washed with any cleaning solution or soap and water. The shroud may also be removed and tossed in the washing machine.

Further, the present invention may be superior to masks because the invention may make it easier for many users to breathe when compared to masks because the fabric is not closed tight over the mouth.

In some embodiments, the present invention may also comprise a method for use of the virus protection apparatus of the present invention which may comprise one or more of the following steps: If the hat is to be removed during the course of the day without replacing the shroud (to eat, wash face, get some air, etc.), this may be done relatively safely and easily as follows: (1) after washing hands, use fingers to loosen the shroud closure mechanism, then pull it open to maximum diameter in all directions. (2) Then use two fingers to pull the hat off from the top using the loop/hook on the top (or side loops at the brim on either side), taking care to lift straight off without touching face. (3) The hat may then either be hung from the top loop/hook on a hook or string, or else set down on a mannequin head or other stand so that the shroud hangs down without contacting any surface. (4) When it is time to put the hat back on, simply lift off hook or stand and lower back on head. Basically, removing and replacing the hat back on is sort of like putting on and taking off a lampshade on a wearer's head.

In an exemplary embodiment, the personal protection equipment (PPE) virus protection headwear apparatus invention may comprise a hat, a shroud, and a connector which when worn may significantly reduce transmission of small virus-sized particles. The headwear may provide 360-degree protection for virus-sized particles and droplets, may prevent accidental or intentional face rubbing contamination, may eliminate extreme positive and negative air pressure differentials that can breach fabric protections, and is comfortable and will therefore be worn more.

For clarity, only those aspects of the virus protection apparatus of the present invention germane to the invention are described, and product details well known in the art are omitted. In addition, many embodiments of the present invention have application to a wide range of industries. To the extent the present application discloses a system, the method implemented by that system is within the scope of the present invention. Further, to the extent the present application discloses a method, a system of apparatuses configured to implement the method are within the scope of the present invention.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims contained herein. It is therefore evident that the particular illustrative embodiments disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein.

While apparatuses and methods are described in terms of "comprising," "containing," or "including" various components or steps, the apparatuses and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the elements that it introduces. If there is any conflict in the usages of a word or term in this specification and one or more patent or other documents that may be incorporated herein by reference, the definitions that are consistent with this specification should be adopted.

Moreover, the use of directional terms such as above, below, upper, lower, upward, downward, left, right, and the like are used in relation to the illustrative embodiments as they are depicted in the figures, the upward or upper direction being toward the top of the corresponding figure and the downward or lower direction being toward the bottom of the corresponding figure.

As used herein, the phrase "at least one of" preceding a series of items, with the terms "and" or "or" to separate any of the items, modifies the list as a whole, rather than each member of the list (i.e., each item). The phrase "at least one of" allows a meaning that includes at least one of any one of the items, and/or at least one of any combination of the items, and/or at least one of each of the items. By way of example, the phrases "at least one of A, B, and C" or "at least one of A, B, or C" each refer to only A, only B, or only C; any combination of A, B, and C; and/or at least one of each of A, B, and C.

What is claimed is:

1. A particle protection apparatus comprising:

a hat configured to be worn on a head of a user;

a shield coupled to or integral with the hat and extending downwardly therefrom; and a shroud coupled to the shield and extending downwardly from the shield and around a perimeter of the hat, and the shroud being formed from a material configured to allow air to pass bi-directionally therethrough and to block a plurality of particles disposed in the air from passing therethrough;

a valve, coupled to the shroud, that is openable and closable and sized to receive a straw;

an impermeable area, coupled to the shroud, that is disposed below the valve, and being configured to be pushed against a mouth of the user, wherein the impermeable area comprises:

a plurality of layers of material that are removable from the shroud; and a tab on an exterior of the impermeable area configured for the user to grasp; and at least one inwardly extending impermeable insert, coupled to the shroud, that is disposed on a side of the shroud and configured to receive a finger of the user.

2. The particle protection apparatus of claim 1, wherein the hat comprises a brim, with the shield coupled to or integral with the brim and extending downwardly therefrom.

3. The particle protection apparatus of claim 2, wherein the brim extends from a crown of the hat and terminates at a brim distal end, and the shield is coupled to or integral with the distal.

4. The particle protection apparatus of claim 2, wherein the hat is a helmet, with the brim extending around a perimeter of the helmet.

5. The particle protection apparatus of claim 1, wherein the shroud is coupled to the shield such that the shroud is configured to be held away from the mouth of the user.

6. The particle protection apparatus of claim 1, wherein a portion of the shroud is configured to horizontally align with the mouth of the user.

7. The particle protection apparatus of claim 1, wherein the shield comprises a transparent plastic material and the shroud comprises a fabric material.

8. The particle protection apparatus of claim 1, wherein the shroud is detachably connected to the hat and to the shield.

9. The particle protection apparatus of claim 1, further comprising a cooling fan integrated with the hat.

10. A particle protection apparatus comprising:

a shield configured to couple to or be integral with a hat and extend downwardly therefrom;

a shroud coupled to the shield and extending downwardly from the shield, the shroud being configured to extend around a perimeter of the hat, and the shroud being formed from a material configured to allow air to pass bi-directionally therethrough and to block a plurality of particles disposed in the air from passing therethrough;

a valve, coupled to the shroud, that is openable and closable and sized to receive a straw;

an impermeable area, coupled to the shroud, that is disposed below the valve, and being configured to be pushed against a mouth of the user, wherein the impermeable area comprises:

a plurality of layers of material that are removable from the shroud; and a tab on an exterior of the impermeable area configured for the user to grasp; and at least one inwardly extending impermeable insert, coupled to the shroud, that is disposed on a side of the shroud and configured to receive a finger of the user.

11. The particle protection apparatus of claim 10, wherein the shroud is coupled to the shield such that the shroud is configured to be held away from the mouth of a user.

12. The particle protection apparatus of claim 10, wherein the shroud is detachably connected to the shield.

13. The particle protection apparatus of claim 1, further comprising a hook attached to a top of the hat and configured to support the hat, the shield, and the shroud on a hat stand or another hook.

14. The particle protection apparatus of claim 1, wherein the at least one inwardly extending impermeable insert extends approximately one to two inches inwardly relative to the shroud and is either provided with a coating or formed from a particle impermeable fabric.

15. The particle protection apparatus of claim 1, wherein the hat comprises one or more holders configured to support the straw.

16. The particle protection apparatus of claim 1, wherein the shroud is configured to hang slack, in use.

17. The particle protection apparatus of claim 10, further comprising a cooling fan integrated with the hat.

* * * * *